US005617690A

United States Patent [19]

Gibbs

[11] Patent Number: 5,617,690

[45] Date of Patent: Apr. 8, 1997

[54] SLATE MOUNTING ASSEMBLY

[76] Inventor: Alden T. Gibbs, 158 Conduit St., Annapolis, Md. 21401

[21] Appl. No.: 4,962

[22] Filed: Jan. 15, 1993

[51] Int. Cl.[6] ..... E04D 1/08

[52] U.S. Cl. ..... 52/518; 52/520; 52/546; 52/547

[58] Field of Search ..... 52/518, 551, 549, 52/544, 546, 552, 547, 520, 550

[56] References Cited

U.S. PATENT DOCUMENTS

| | | | |
|---|---|---|---|
| 145,529 | 12/1873 | Ryan . | |
| 718,165 | 1/1903 | Sneden | 52/547 X |
| 1,004,338 | 9/1911 | Austin | 52/518 |
| 1,173,499 | 2/1916 | Fleischmann | 52/546 |
| 1,270,905 | 7/1918 | White . | |
| 1,582,281 | 4/1926 | Krindler . | |
| 1,738,006 | 12/1929 | Houghton . | |
| 1,850,680 | 3/1932 | Levin . | |
| 1,925,939 | 9/1933 | Sherman | 52/551 X |
| 2,106,948 | 2/1938 | Harrington | 52/547 |
| 2,292,984 | 8/1942 | Alvarez, Jr. | 52/551 X |
| 2,308,129 | 1/1943 | Tummins | 52/547 |
| 2,648,103 | 8/1953 | Wahlfeld | 52/551 X |
| 3,089,211 | 5/1963 | Perusse . | |
| 3,703,062 | 11/1972 | McKinney . | |
| 4,096,671 | 6/1978 | Aarons . | |
| 4,104,841 | 8/1978 | Naz . | |
| 4,187,661 | 2/1980 | Poiry . | |
| 4,292,781 | 10/1981 | Chalmers et al. . | |
| 4,422,278 | 12/1983 | Fujihiro et al. | 52/547 X |
| 4,426,823 | 1/1984 | Kobe . | |
| 4,782,638 | 11/1988 | Hovind . | |
| 4,958,471 | 9/1990 | Waddington . | |

FOREIGN PATENT DOCUMENTS

| | | | |
|---|---|---|---|
| 146969 | 2/1978 | Denmark . | |
| 0167032 | 6/1985 | European Pat. Off. . | |
| 0271400 | 11/1987 | European Pat. Off. . | |
| 0409720 | 7/1990 | European Pat. Off. . | |
| 0497690 | 1/1992 | European Pat. Off. . | |
| 531256 | 10/1921 | France | 52/547 |
| 2189602 | 6/1972 | France . | |
| 2336528 | 12/1976 | France . | |
| 2562591 | 4/1984 | France . | |
| 2566446 | 12/1985 | France . | |
| 3232106 | 3/1984 | Germany . | |
| 67058 | of 1914 | Switzerland . | |
| 1952 | of 1911 | United Kingdom . | |
| 28089 | of 1914 | United Kingdom . | |
| 616956 | 1/1949 | United Kingdom | 52/544 |
| 1570441 | 10/1977 | United Kingdom . | |
| 2169933 | 1/1985 | United Kingdom . | |
| 2172620 | 1/1985 | United Kingdom . | |
| 2202245 | 9/1988 | United Kingdom . | |
| 2248253 | 4/1992 | United Kingdom . | |
| WO89/00634 | 1/1989 | WIPO . | |

OTHER PUBLICATIONS

*Slate Roofs,* National Slate Association, pp. 6, 14, 47, 72 (1953).

Levine, "Slate: An Historic and Repair Profile," *Inspired, A Quarterly Publication Devoted to the Preservation of Historic Churches and Synagogues* (1987).

*The NRCA Steep Roofing Manual,* National Roofing Contractors Association, pp. 76, 91, 92 (1990).

*Primary Examiner*—Rodney M. Lindsey

*Attorney, Agent, or Firm*—Connolly & Hutz

[57] ABSTRACT

The invention is a mounting assembly for attaching panels to a support surface. It includes various designs of spaced elongated mounting tracks secured to the support surface (usually a deck or wall), and panels provided with mounting devices, such as clips, detachably secured at opposite edges of each panel. These devices serve as the intermediary in attaching the panel to the mounting track, which, in turn, is fastened to the support deck or to an other appropriate surface. Each panel is attached to a mounting track in a way that permits arrangement in courses, with the panels side by side, and when appropriate, in overlapping courses.

25 Claims, 6 Drawing Sheets

Fig. 1.
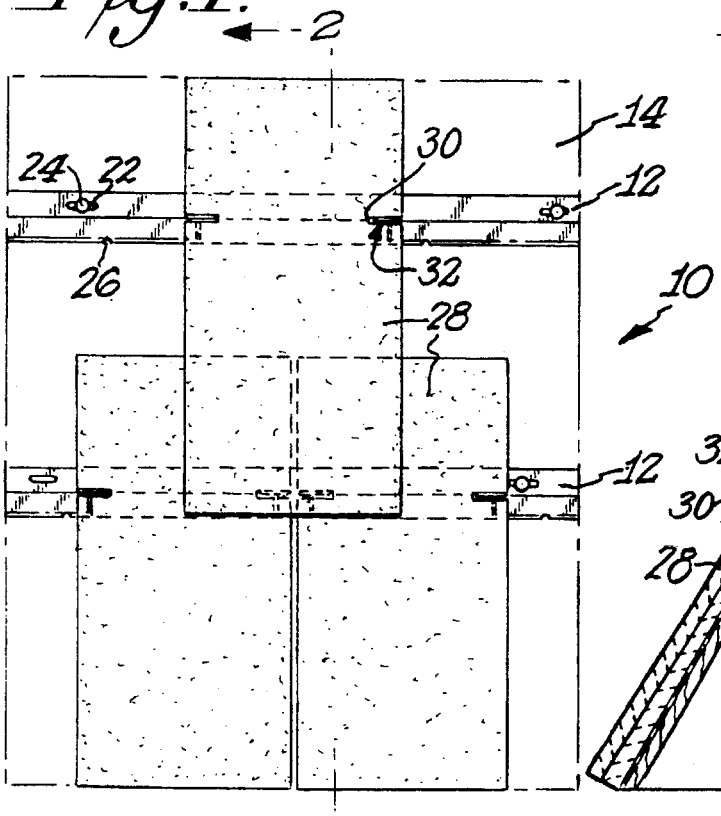
Fig. 2.
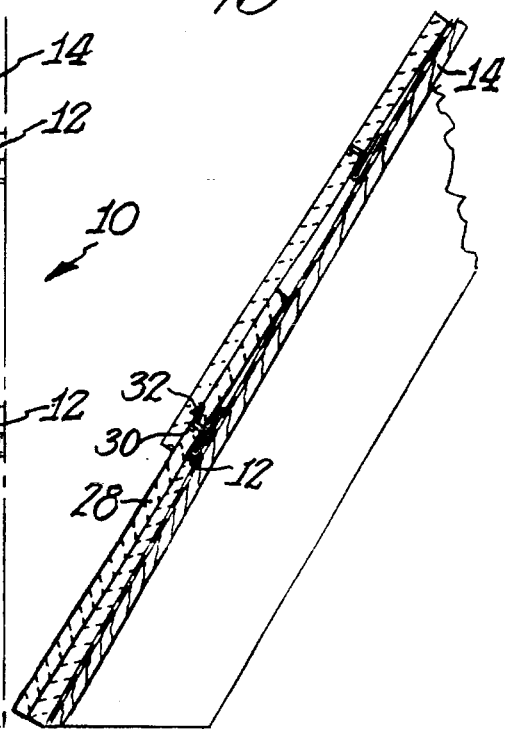
Fig. 4.
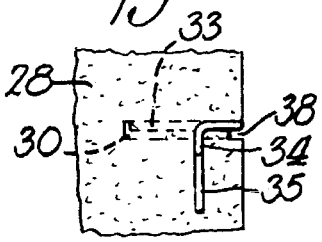
Fig. 3.
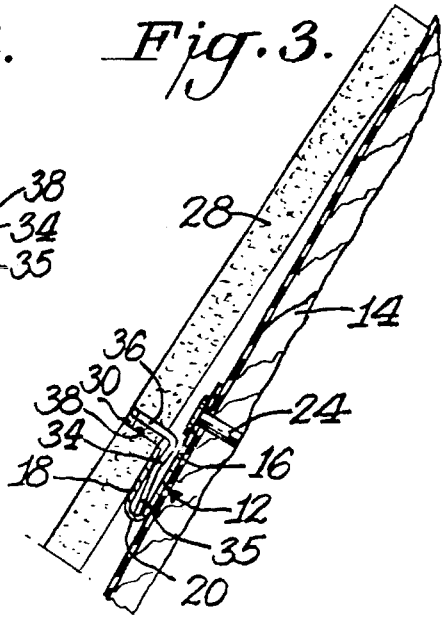
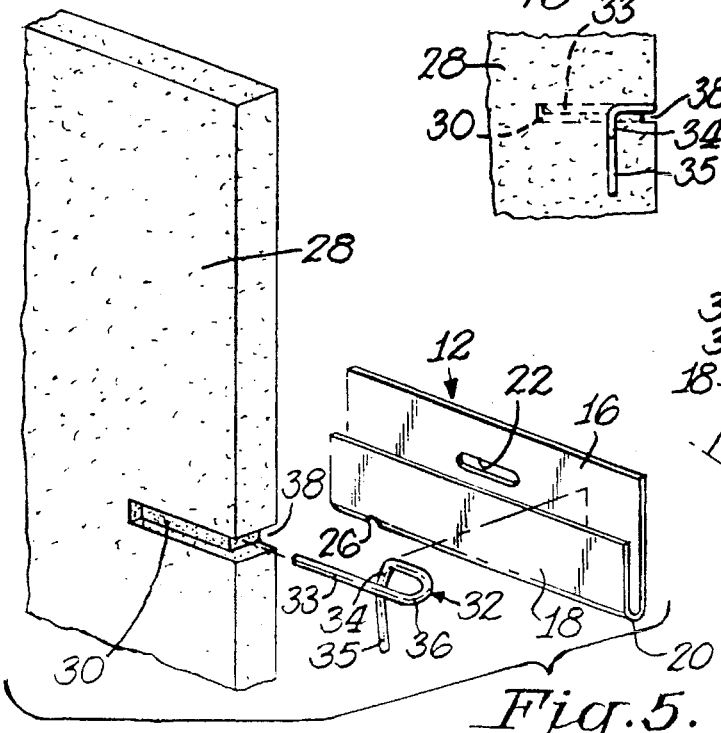
Fig. 5.

SLATE MOUNTING ASSEMBLY

BACKGROUND OF THE INVENTION

Various techniques are known in the art for applying panels to cover a deck or to function as the siding of a wall. Slate is a particularly desirable type of panel. It is difficult to mount on a deck by virtue of being a natural product, lacking true uniformity in dimensions, brittle, and of varying hardness and characteristics. Conventional mounting is done by nailing the individual slate panel to a deck through holes previously formed in the slate. The procedure has not changed essentially for centuries. An alternative procedure is to use hooks that are attached directly to the deck, and that engage the edges of the slate. There are significant drawbacks to the hook system, and also to the nailing procedure, which requires much skilled labor and involves breakage.

SUMMARY OF THE INVENTION

This invention provides a panel mounting assembly for the application of multiple panels to a track or a portion of a track.

An intermediate device between the slate and a mounting track which is mounted on the support deck is used. Both the mounting track and the intermediate device can take several forms, but, all employ a device that joins the panel to the mounting track, the mounting track being attached directly to the support deck.

The mounting track creates a straight line of attachment for the panels, such as slates, to be applied. This facilitates alignment and does not require skilled or specialized labor.

The intermediate device may be a clip, band, or other attachment to the slate that, in turn, attaches to the track.

The panel, for most forms of this invention, does not require nail holes. The panel may be modified by grooving, notching, or other alteration to accommodate the device, such as a clip, in a way to provide alignment, stability, security of attachment to the mounting track, and to meet other requirements for a specific application. The number of panels applied by this system may vary from one to many, depending upon the application, and can be intermixed with portions of the mounting track to which panels have been applied by a different system.

The mounting track and the intermediate device may be made of any appropriate material. The application of tracks would be suitable for covering buildings or other structures. Where necessary, dependent portions of the mounting deck would be provided with weep holes, and securing of the mounting track to the support deck would be done, in most cases, through elongated holes to allow for expansion and contraction.

Any of several fastenings of the mounting track to the support deck may be employed, including, but not limited to nails, screws, adhesives, and staples.

The concept of this system, consisting of an applied mounting track and an applied slate component, also includes the use of adhesives or bonding agents. In this version an adhesive is applied to the under surface of the panel. An adhesive is also applied to the surface of the mounting track. The panel is then bonded to the mounting track by interaction of these two adhesive layers. A third independent support or spacer. also adhesive to the structures it contacts, could be used. This would resemble a mounting track, but the attachment of this track-equivalent would be by adhesive or bonding to the panel that lies on top of it and to the deck on which it lies.

THE DRAWINGS

FIG. 1 is a top plan view showing the panel mounting assembly of this invention;

FIG. 2 is a cross-sectional view taken through FIG. 1 along the line 2—2;

FIG. 3 is an enlarged view of a portion of the assembly shown in FIG. 2;

FIG. 4 is a rear plan view of a portion of the assembly shown in FIGS. 1–3;

FIG. 5 is an exploded view of the components used in the assembly of FIGS. 1–4;

DETAILED DESCRIPTION

Figure 6:
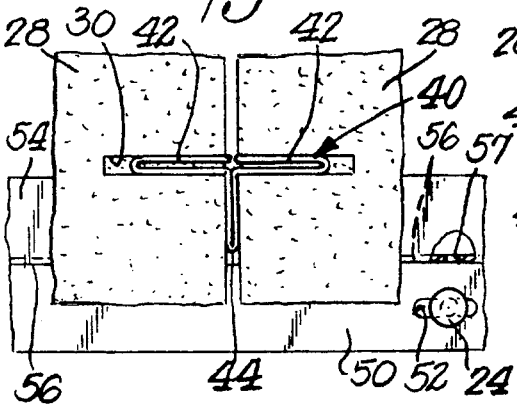
FIG. 6 is a top plan view of an alternative assembly in accordance with this invention.

To facilitate an understanding of the invention the following definitions will apply to the description of the invention.

Panel: this is used synonymously with shingle, tile, or individual slate piece. Whereas the principle application of this term would refer to uses in roofing, panels may also be applied to any surface, vertical, inclined, horizontal and used for purposes other than roofing.

Support deck: any surface for which this application method is suited. It is synonymous with the roof deck, but, where appropriate should be interpreted as vertical or horizontal wall, surface, underlying structure, or other term describing the substrate to which the mounting track is attached.

Mounting track: a horizontal band, ridge, wire, extrusion, ribbon, or other form, of whatever material, attached to the deck and to which the panel is attached, usually, but not always, by means of an intermediary device.

Intermediary device: the device is an intermediate between the panel and the mounting track. It may be in the form of a clip, a band, or other form that adapts to the panel and that secures the panel to the mounting track. The slate or panel may have to be altered to accommodate the device. The device is coordinated in size and contour to engage the mounting track with the mechanical properties required. The device may also take the form of an adhesive or a bonding system that serves as the intermediary between the panel and the mounting track or to the panel or the underlying mounting track. The device in that version combines the function of mounting track and track attachment. For example, the device could be an extrusion of triangular cross section, bonded to both the deck and the panel, and offering the proper support and alignment to the panel. A two part coating system could be used, with no adhesion being developed until the two parts, one on the panel and one on the device, come into contact, and a similar two part system bonding the device to the deck.

This invention overcomes significant difficulties in economical and effective mounting of panels or tiles to a support deck or similar structure. It is to be understood, however, that although the invention will be described specifically with respect to slate panels, and tracking, the invention may also be used for attaching panels made of other materials to surfaces other than roofs or roof decks.

FIGS. 1–5 illustrate one form of panel mounting assembly 10. The illustration shows several parallel mounting tracks 12 mounted to a support deck 14. FIG. 5 shows each mounting track as a single member having a base portion 16 and an upright leg or offset portion 18 joined at the bight section 20. As also illustrated in FIG. 5, the base 16 includes an elongated slot 22 for receiving a suitable fastener 24 (FIG. 3) such as a nail, for securing the mounting track 12 to the support deck 14. By using an elongated slot, the position of the panels 28 may be adjusted and this elongation also permits expansion and contraction of the tracking material.

FIG. 5 also shows at least one drain or weep hole 26 at the lowest portion of the bight 20 of the track 12. Several drain holes may be needed.

FIG. 5 shows a notch or a groove 30 on each vertical edge of the panel 28. The device that attaches the slate to the mounting track is shown in FIGS. 1–5 in the form of a spring clip 32 having a horizontal leg 33 and a vertical leg 34 connected by a partial loop 36. The horizontal leg 33 would be inserted into the groove 30 of the slate 28 with the loop 36 coming to lie in the notch 38 at the edge of the slate which is actually at the extremity of the groove 30. The vertical leg 34 would fit over the lip 18 of the track 12 in the space between the base 16 and the lip 18 as shown in FIG. 3. The tip 35 of leg 34 may be bent or formed to prevent snagging.

Clip devices 32 would be applied to opposite vertical edges of each panel and would engage the mounting track as previously described. The clip may be bent so as to provide a clamping action upon the slate in the groove, and, also, may have its descending or vertical leg bent and the tip formed or angled so as to prevent snagging of the underlying felt or track. Subsequent panels would be applied according to the spacing desired so that a course of panels would result. Each section of mounting track may be as long as needed for the space to be covered, but, the length may be restricted for ease of handling, carrying, packing, shipping, storing, and the like. In some applications overlapping courses may not be desirable. The system would accommodate such special requirements with ease.

FIGS. 6–9 illustrate a variation of the invention in which a single device-clip engages adjacent slates. The clip 40 is similar to the clip 32 in that it is a spring type clip. Clip 40 is bent as illustrated to form a pair of U-shaped clamp arms 42 having bight sections 46 and interconnected by a double thickness vertical leg 44. The preformed groove 30 in the slate panel 28 would accept the clamp arms 42 and confine them completely within the slate, avoiding protrusion above the slate's upper surface so as not to interfere with subsequent courses of slate. Furthermore, the shoulders formed by the groove 30 function as butting surfaces for the clip, adding to the stability of the panel when mounted to the mounting track. The edge notch 38 could be dimensioned to further confine the clip within the slate panel and contribute to the stability of the system. The use of the notch is optional.

In addition to providing attachment of the panel to the mounting track, the mounting tracks can have other uses during the mounting process. They could be employed as rails upon which a carriage would ride. This carriage would contain panels, clips, and other supplies needed by the applier and would be displaced as the course of panels is added to.

Figure 10:
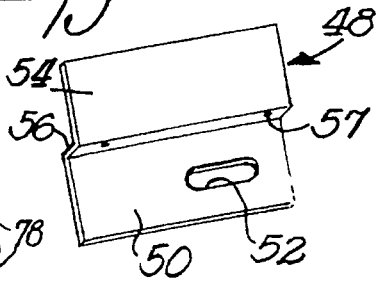
FIGS. 10–13 are perspective views of alternative forms of mounting track usable in the assembly of this invention.

The mounting track may take various forms, illustrated in the drawings. FIG. 10, for example, shows a Z-shaped track 48 with a base portion 50 connected to an offset 54 by bent portion 56. Weep holes 57 may be in bent portion 56. Track 48 would be secured to the support surface by suitable fasteners through elongated slots 52 similar to those in the base portion 16. Although sharp bends are shown in FIG. 10, less acute bends could be used, and, the planes of the two sections of the mounting track need not be parallel, but, could be at an angle to each other that would facilitate application of the intermediate angle to devices or hold them better after they have been applied.

Figure 11:
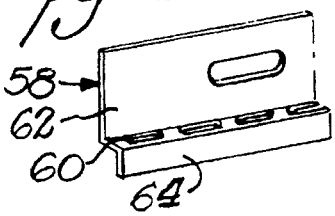
Figure 12:
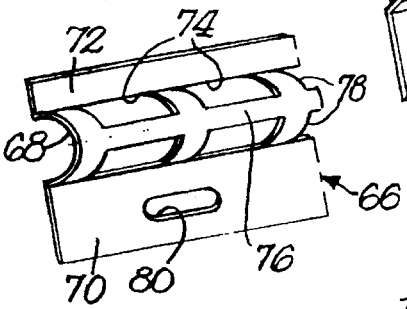

FIGS. 11 and 12 show variations of the mounting track employing principles similar to those just described. Track 58 of FIG. 11 has a base 62 connected to offset 64 with weep holes in the connecting portion. Track 66 of FIG. 12 includes lower and upper base portions 70, 72 interconnected by arcuate ribs 78 connected to each other by backbone 76 to form a bulge 68. Mounting slots 80 are in base 70.

Figure 13:
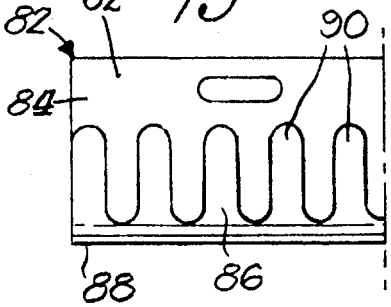
Figure 13A:
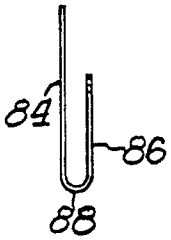
FIG. 13A is a side view of the mounting track shown in FIG. 13.
Figure 14:
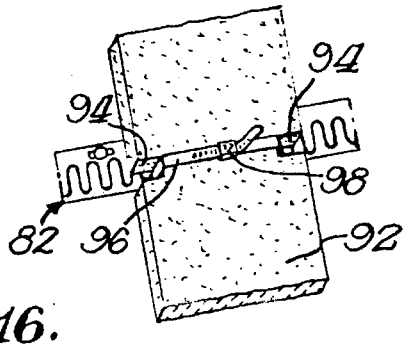
FIG. 14 is a perspective view of a modified mounting system in accordance with this invention.

FIGS. 13 and 14; 15 and 16; and 17, 18 and 19 show variations of an intermediate device that takes the form of a band encircling a panel that may be grooved, notched, or both, and joined to the mounting track by projections in the track itself or by a sliding clip arrangement attached to the track. The projections may be in the form of fingers bent upward from the lower edge of a track, or fingers formed as cutouts along the upper edge of a Z-shaped track. In both cases these fingers engage a band looped around the slate and retained by notch, groove, or a combination of notch and groove.

As shown in FIGS. 13 and 13 a mounting track 82 has a base 84 with an offset 86 interconnected by bight portion 88. Fingers 92 are formed in offset 86. FIG. 14 shows track 82 mounted to panel 90 by a loop or band 96 which functions as the intermediary device. Band 96 is located in notches 94 of panel 92 and is held by fingers 90. The ends of band 96 are locked together by a suitable fastener 98.

Figure 7:
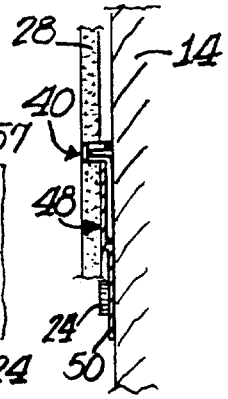
FIG. 7 is a side elevational view of the assembly shown in FIG. 6.
Figure 8:
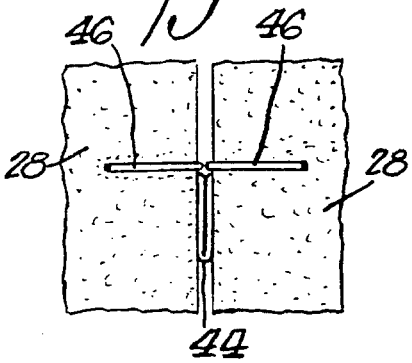
FIG. 8 is a bottom plan view of a portion of the assembly shown in FIG. 6–7.
Figure 9:
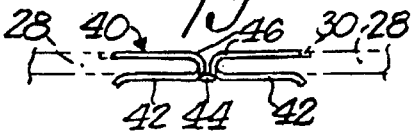
FIG. 9 is a top view of a portion of the assembly shown in FIGS. 6–8.
Figure 15:
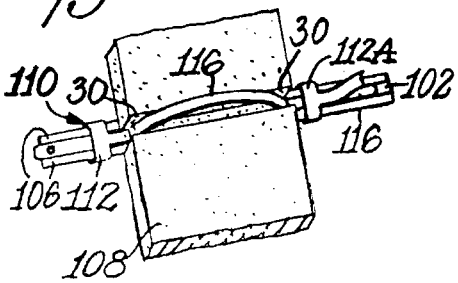
FIG. 15 is a perspective view of yet another alternative practice of this invention.
Figure 16:
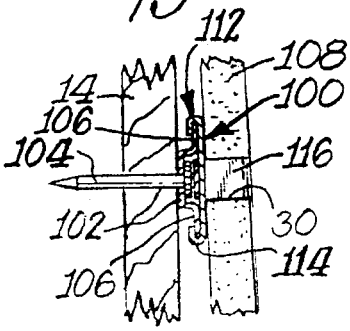
FIG. 16 is a side view of a portion of the assembly shown in FIG. 15.

In FIGS. 15–16 the mounting track 100 is secured to support 14 by fastener 104. Track 100 has a center portion 102 with elevated edges 106. These elevated edges permit a clip 110 with elongated tongue 116 to slide along the track. As shown in FIG. 15 clip 110 is in the form of a slider 112 having ends 114 which bend around elevated edges 106 of track 100. The tongue 106 is an extension of slider 112. The tongue engages the slate 100, using notches, a groove 30, or a combination of both, and is secured by passing it under the sliding clip 116 for the next slate. A section of this is seen in FIG. 16, and a variation that dispenses with the sliding clip, but that uses a projecting finger arrangement on the track to hold a ribbon that passes from grooved slate to grooved slate or from notched slate to notched slate is seen in FIG. 7.

Figure 17:
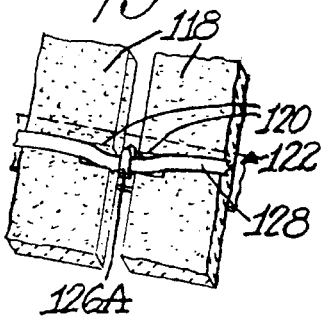
FIG. 17 is a perspective view of a further alternative practice of this invention.
Figure 18:
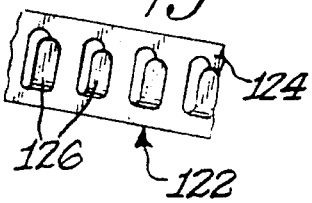
FIG. 18 is a plan view of the mounting track used in the embodiment of FIG. 17.

Appropriately grooved or notched, or grooved and notched, slates would be used as might be used in the previously described arrangements (FIG. 17; FIG. 18). As shown adjacent panels 118, 118 have notches 120. Track 122 has fingers 126 formed in base 124 which could be pressed back into base 124 so that only a selected finger 126A would extend between panels 118 and 118 to receive a ribbon 128.

Figure 19:
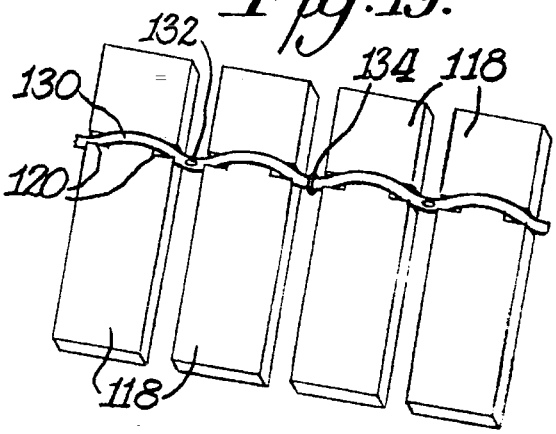
FIG. 19 is a perspective view of yet another embodiment of this invention.

In FIG. 19 a ribbon 130 similar to that used in FIG. 17 is employed, and is secured to the support deck directly by nailing 132 or stapling 134 between the slates 18.

Figure 21:
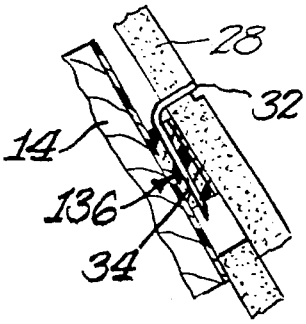
FIG. 21 is a side view showing use of the mounting track of FIG. 20.
Figure 20:
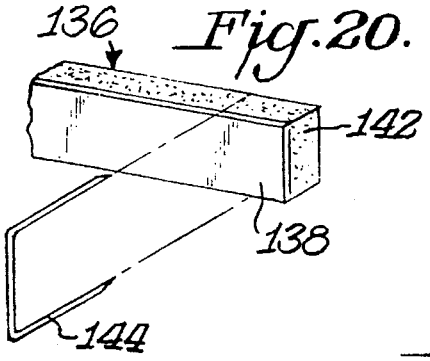
FIG. 20 is a perspective view of an alternative mounting track in accordance with yet another embodiment of this invention.

FIG. 20 and FIG. 21 illustrate a system in which a spacing strip 136 consisting of a foam or other appropriate material is used between a ribbon and the support track. The foam spacer 142 may be bonded to the metal ribbon 138. The entire structure is then stapled 144 or otherwise fastened to the track deck. A bent clip 32 is then applied to a grooved, notched, or grooved and notched slate, along both vertical edges, and the descending part of that clip (intermediary device) is then placed through the foam, between the ribbon and the track 14. If used in this fashion the foam 142 serves as a spacer for the initial placement of the metal ribbon 138, with the metal ribbon actually holding the slate by means of the attached clip. A modification of this version would dispense with the foam entirely, inserting the clip directly behind the ribbon that would be spaced from the track by a partially driven staple or nail. Furthermore, additional variations of this could be used in which the foam is replaced by some other appropriate material, such as paper or corrugated paper with the openings oriented to accept the descending member of the clip (device).

Figure 22:
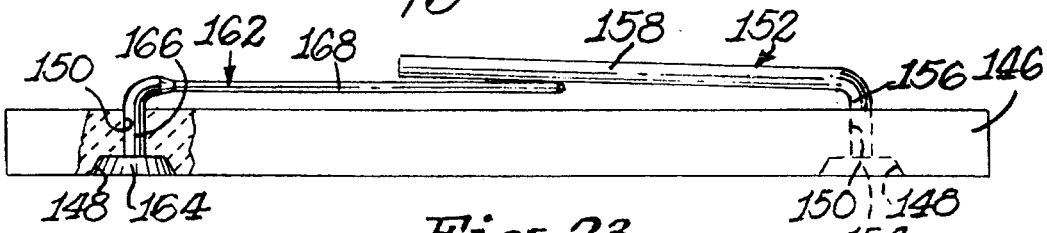
FIG. 22 is an elevational view of a form of slate panel and mounting members in accordance with this invention.
Figure 23:
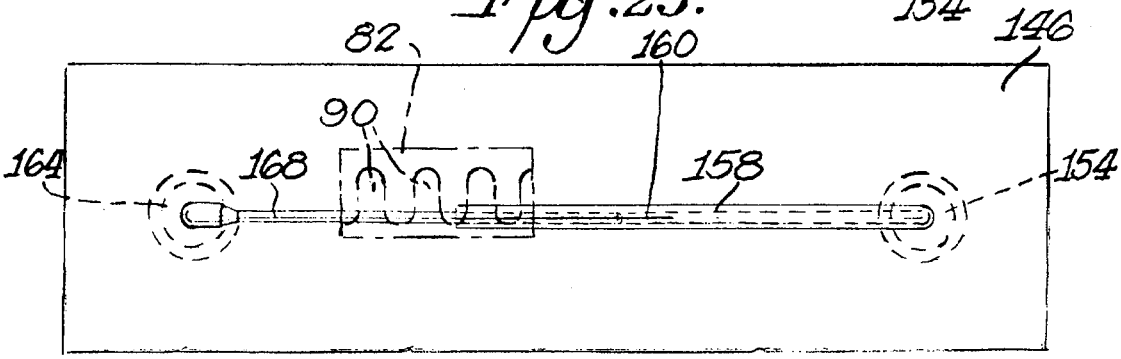
FIG. 23 is a plan view showing the mounting of the slate panel of FIG. 22.

FIG. 22 and FIG. 23 show a system for using slates 146 that do have holes punched in them. Essentially, nail shaped devices 152, 162 with heads 154, 164 similar to those found on nails are placed into the slate holes. Slate holes characteristically are conical, having a larger and a smaller end 148, 150. The nail heads are placed so as to seat in the crater at the end of the hole that is larger, and the extension of the nail would then be joined to an equivalent nail placed in the other hole of the slate. The second nail and the first nail would be constructed to enable their meeting in a permanent joint. The illustration shows this joint being formed by having one nail 152 hollow 158, partially slitted 160, to accept a smaller, solid end 168 of the opposing nail 162, forming a jammed fit. This produces a continuous shallow U-shaped rod that stretches from one nail hole to the other and that would be supported by engaging finger-like projections 90 on a track similar to that illustrated in FIG. 13.

Figure 24:
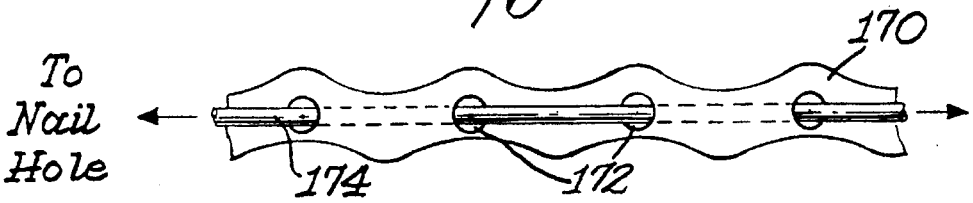
FIG. 24 is a plan view of yet another practice of this invention.

The ends of the nail-shaped devices could also be threaded through a perforated ribbon 170 (see FIG. 24) where the nail shaped device is designated 174 and is threaded through holes 172.

Figure 25:
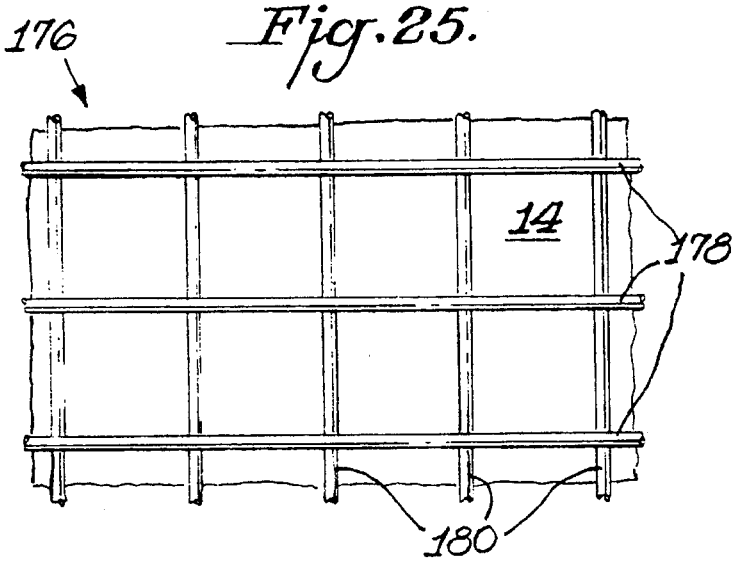
FIG. 25 is a plan view of a further alternative mounting track in accordance with this invention.

FIG. 25 shows a different form of attachment in that a rectangular grid 176 of wires is applied to the support deck 14. The horizontal wires 178 are laid on top of the vertical wires 180, and, thereby, are spaced from the deck 14. These horizontal rods 178 would then be used to replace the tracks and the hooks or clips (devices) would attach to these horizontal members of the rectangular grid.

The grid method of application is also particularly advantageous because it may be used on support decks of unconventional surface. It has the ability to span gaps in the deck, and, is exceedingly economical in the labor required for installation. A wide range of material could be used for the grid itself, including those materials already having wide acceptance in the roofing industry. Furthermore, the system has adaptability to various deck contours upon which slate application might otherwise be prohibitively complicated, or for which skilled labor would be expensive or unobtainable.

The grid 176 would be of a size and dimensions to enable the desired placements of panels mounted that would then be attached by an intermediate device to the horizontal member 178. For example, the grid opening might be 7 inches square. The cost could be reduced by having the horizontal members made of metal, fitted into notches in plastic vertical members.

The recesses formed by notching or grooving panels are unique. These recess differ significantly from the holes that conventional practice employs. These notches and recesses, particularly the notches, provide the ability to mount the slate panels with various techniques that do not require the use of tracks or strips, but, also may be combined with tracks and clips or bands.

Figure 26:
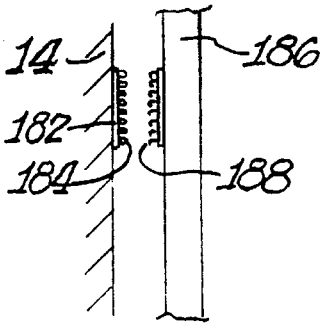
FIG. 26 is a side elevational view showing yet another practice of this invention.

FIG. 26 shows a fabric type fastener in which an adhesive or other bonding agent is used to attach a hook-and-loop pair to the undersurface of the panel 186 and to the support track 14. In FIG. 26 the strip 182 with loops 184 is secured to track 14 while the strip with hooks 188 is secured to panel 186.

Figure 27:
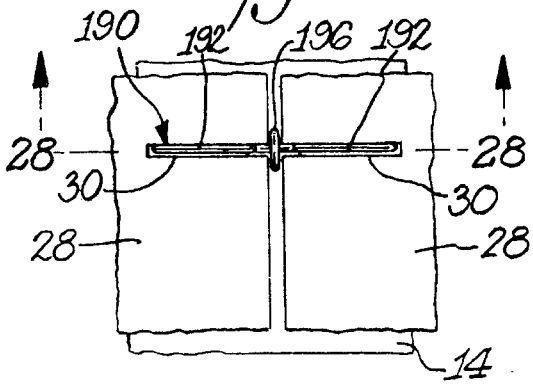
FIG. 27 is a plan view of yet a further panel mounting assembly in accordance with this invention.
Figure 29:
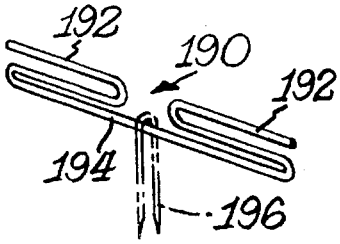
FIG. 29 is a perspective view of the clip used in the panel mounting assembly of FIGS. 27–28.
Figure 28:
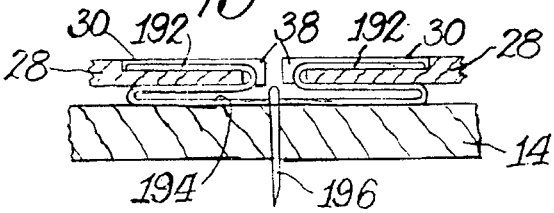
FIG. 28 is a cross-sectional view taken through FIG. 27 along the line 28—28.

FIGS. 27–29 show an alternative panel mounting assembly in accordance with this invention. As shown therein the panels 28 would be mounted directly to the support deck 14 without the use of mounting tracks. This is accomplished by means of a clip 190. clip 190 has some similarities to the clip 40 shown in FIGS. 6–9 in that the same clip is used for attachment to a pair of side by side panels 28. Use is also made of the notches or grooves 30 which extend inwardly from the sides of the panels and of the notches 38 located at the side edges.

As shown in FIGS. 27–29 clip 190 includes a pair of aligned clamp arms 192 which are integral with each other by an intermediate portion 194 which is in the same plane as clamp arms 192, but offset from the clamp arms. Thus, intermediate portion 194 could be placed directly against the support deck 14 (as shown in FIG. 28) and secured to the support deck in any preferably manner such as by staples 196. This arrangement which provides a spring fit overcomes the major disadvantages of commercial nailing.

Figure 30:
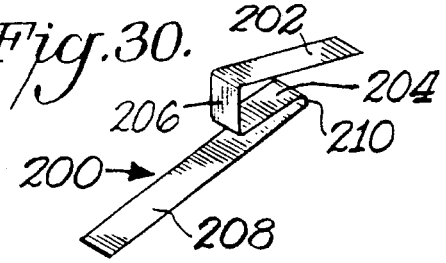
FIG. 30 is a perspective view of yet another clip in accordance with this invention.
Figure 31:
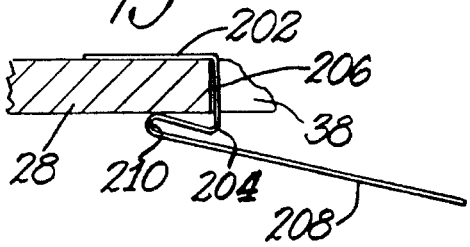
FIG. 31 is a side elevational view in cross-section showing the clip of FIG. 30 for holding a panel.

FIG. 30 illustrates an alternative clip 200 in accordance with this invention. Clip 200 could be made of wire or thin ribbon material having sufficient resiliency to be spring mounted to panel 28. In the use of clip 200, however, it is not necessary to provide a groove, such as groove 30, on the upper surface of panel 28 because of the thinness of clip 200. Instead an edge notch 38 would be used in which the clip 200 would be mounted. As shown in FIG. 31 clip 200 includes spring arms 202, 204 interconnected by intermediate portion 206 with an extended leg 208 extending from the bend 210 of clip 200.

Figure 32:
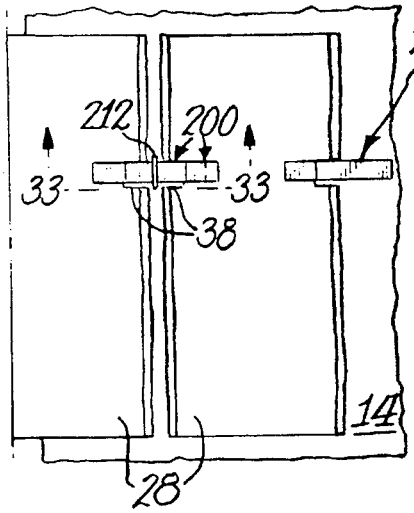
FIG. 32 is a plan view showing the clip of FIGS. 30–31 mounted directly to a deck.
Figure 33:
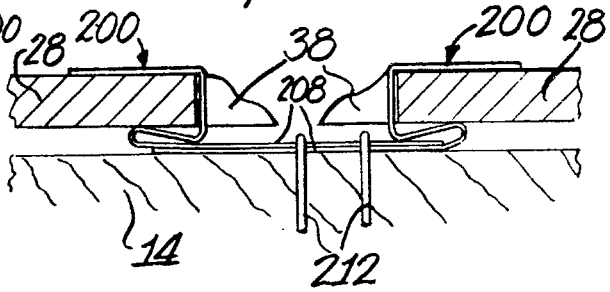
FIG. 33 is a cross-sectional view taken through FIG. 32 along the line 33—33.

FIGS. 32–33 show the use of clip 200 for being mounted directly to a deck 14, thus eliminating the need for a track. The clip 200 and its panel 28 could be secured to the track by, for example, staples 212 as shown in FIGS. 32–33 which could be applied by an automatic tool such as a staple gun without straining the panels. FIG. 33 illustrates how a pair of legs 208 overlap each other and are mounted to deck 14 by staples 212. If desired, the legs 208 could be slid under the staples where the staples are premounted to the deck slightly spaced from the deck. FIG. 33 best illustrates how the edge notch 38 would be formed in a standard chamfered slate edge without forming a top surface groove. Such edge notches 38 in the panel's vertical edges would be much simpler and easier to manufacture than conventional holes which due to the nature of the material must be individually punched or drilled. The edge notches 38 could be formed or sawed, for example, along a rack of panels in one operation. In the case of roofing slate, the notch 38 need only recess enough for the clip to enter the full thickness of the panel, that is, beyond the customary chamfered edge.

Figure 34:
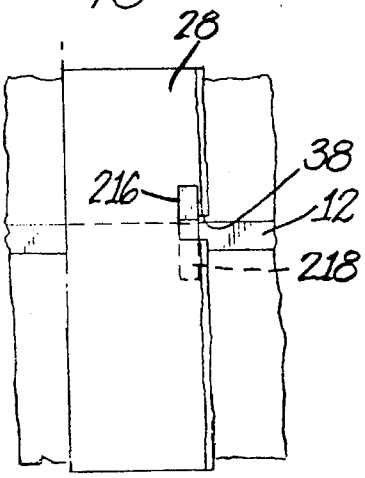
FIG. 34 is a plan view showing a modified clip in accordance with this invention.
Figure 35:
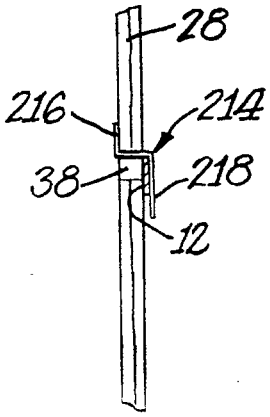
FIG. 35 is a side view partly in section showing the clip of FIG. 34 mounted to a track.

FIGS. 34–35 illustrate a further variation of this invention wherein a Z-type clip 214 made of thin ribbon material similar to clip 200 is used for mounting panels 28 to a track 12. In this practice of the invention an edge notch 38 is formed and the clips 214 are mounted perpendicular or turned 90° from the type of mounting described, for example, with respect to the embodiments of FIGS. 1–9. Thus, a leg 216 of each clip would extend on the outer surface of panel 28 while the other leg 218 would hook onto track 12.

Figure 36:
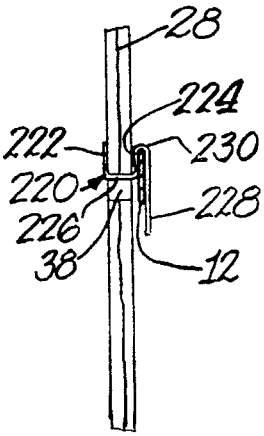
FIG. 36 is a side view in elevation showing the clip similar to that of FIG. 30 mounted to a track.
Figure 37:
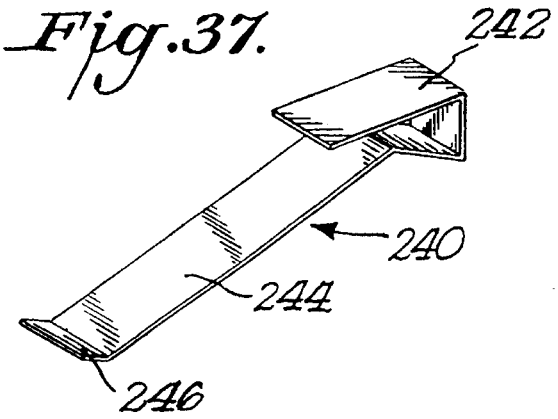
FIG. 37 is a perspective view of yet another clip in accordance with this invention.

FIG. 36 shows a modification of the clip 214 wherein the clip 220 has a pair of spring arms 222, 224 provided by the bend 226 with a further leg 228 extending from bend 230. As illustrated the spring arms 222, 224 are mounted in edge notch 38 in an orientation similar to clip 214 where arm 222 is on the outer surface of panel 28. The spring arms 224 and 228 in turn are hooked over and secured to track 212.

It is to be understood that although FIGS. 34–36 have been described with respect to track 12 other forms of track may be used for clips 214 and 220.

Clips 200 and clips 214 and 220 have in common that each clip is formed from a thin, flat, springy material and includes oppositely extending arms or legs. One of the arms would be disposed on the outer surface of the panel and the other arm would be disposed in an opposite direction and would be used for mounting the clip end panel to either the deck (clip 200) or a track (clips 212 and 220).

FIGS. 37–40 show yet another form of this invention wherein the intermediary member 240 is in the form of a thin flat springy material having a clip end 242 and an outwardly extending leg 244 which terminates in an inclined end 246.

Figure 39:
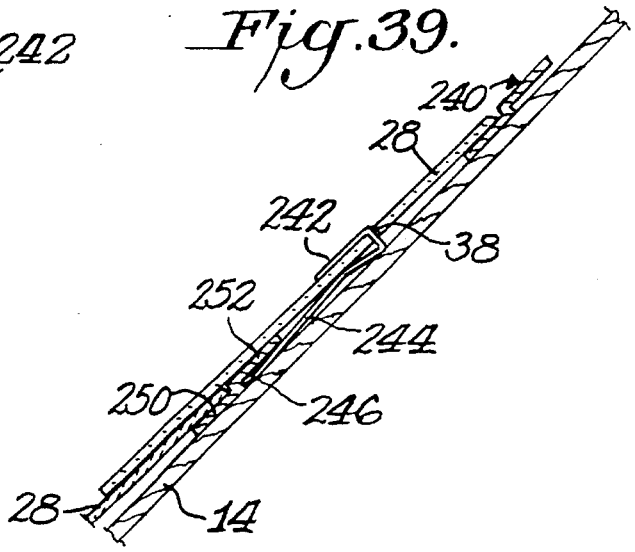
FIG. 39 is a side elevational view partly in section of the clip of FIGS. 37–38 mounting slate panels to a deck.
Figure 38:
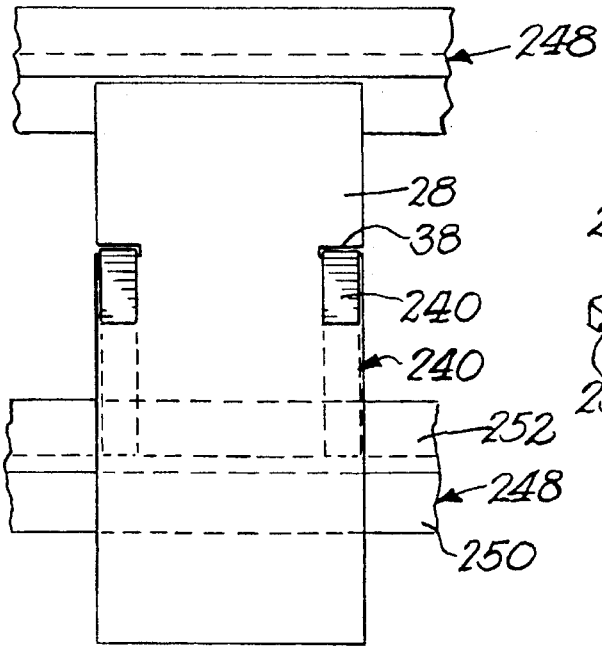
FIG. 38 is a plan view showing a set of the clips of FIG. 37 used for mounting a slate.
Figure 40:
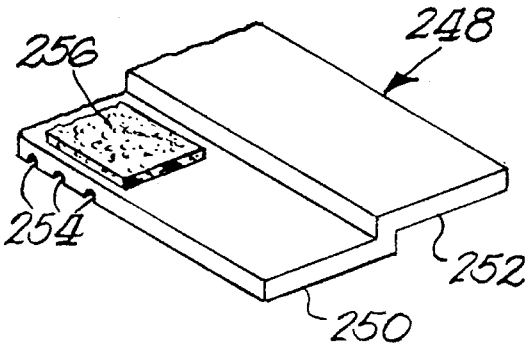
FIG. 40 is a perspective view of a modified form of mounting track shown in FIGS. 38–39.

Intermediary member 240 could be used with any suitable track, such as track 248 shown in FIG. 40. As shown therein track 248 includes a base portion 250 and an offset portion 252 so that a space would be created below offset portion 252. In use a plurality of such tracks would be mounted spaced from each other as shown in FIGS. 38–39. A pair of clips 240 would be secured to panel 28 by being inserted into notches 38 with the panel 28 firmly gripped by the clip ends 242. The leg 244 would be inserted in the space between offset 252 of track 248 and deck 14 as best shown in FIG. 39. If desired, base portion 250 could be provided with a plurality of weep holes 254 as illustrated in FIG. 40.

If desired, a cushioning strip 256, which is partially shown in FIG. 40, could be mounted on the upper surface of base member 250 to cushion the panel 28. The cushioning strip would also compensate for any irregularities in the panel thus providing a smoother laying roof and diminishing breakage by distributing the forces due in particular to walking on the roof.

An advantageous feature of the embodiment of FIGS. 37–40 is that the track 248 could be made of an inexpensive material such as wood or easily extrudable products. FIG. 40 illustrates the track to be formed from a one piece member. The individual parts 250, 252, however, may simply be two slats of wood secured together so as to form a general Z arrangement.

An alternative structure for the track would be simply to provide longitudinal spacers on the roof deck and then secure horizontal or transverse slats on top of the spacers so that the legs 244 of clip 240 could be inserted under the slats against some stop member.

Reduction of any unsupported span may be achieved by beveling the track which effectively extends the bearing surface downwardly. The placement of the cushioning strip 256 can also have a similar effect on a track of rectangular cross-section.

It is to be understood that the various embodiments described are exemplary practices of the invention and that features from one embodiment may be used with features from other embodiments.

What is claimed is:

1. A mounting assembly for mounting panels to a structure for forming a roof or wall for the structure wherein the structure has framework, said assembly being in combination with said structure and said panels, said assembly comprising a plurality of spaced parallel generally flat mounting tracks, each of said tracks having a base portion mounted against and to said framework, each of said tracks having fastener accommodating structure, a plurality of rows of mounting panels, each of said rows of panels being associated with a respective one of said tracks, each of said panels having two spaced side edges, surface indentations in each of said panel side edges, a fastener in the form of an intermediary device engaged in each of said surface indentations, each of said fasteners being secured to its said track by being detachably hooked to said fastener accommodating structure, each of said panels being imperforate except for any perforations at said surface indentations, said rows of panels being mounted in an overlapping manner with respect to each other to cover and conceal said fasteners, said tracks being separate and distinct from said framework, each of said tracks having an offset portion extending away from said base and spaced from said framework, said offset portion comprising said fastener accommodating structure, said mounting track being made of a one-piece z-shaped member comprising said base portion having a bent transition portion which terminates in said offset portion, drain holes being in said transition portion, and fastening openings being in said base portion.

2. The assembly of claim 1 wherein each of said intermediary devices is in the form of a clip made of springy material and having at least one horizontal arm and one vertical leg, said horizontal arm being mounted in a respective surface indentation, and said leg being engaged with said mounting track.

3. The assembly of claim 2 wherein each of said clips consists of a wire member having a single horizontal U-shaped clamp arm and a single vertical leg connected to said arm by a partial loop portion.

4. The assembly of claim 1 wherein said surface indentation is a notch, each of said intermediary devices being in the form of a clip made of a springy material and having a clip end and a leg extending outwardly therefrom whereby said clip end may be mounted in said notch and said leg may be inserted below said offset portion and in contact with said mounting track.

5. The assembly of claim 4 wherein a cushioning strip is mounted on said track for being disposed below said panel.

6. The assembly of claim 1 wherein each of said surface indentations is a notch.

7. The assembly of claim 6 wherein said notches in each of said panels are aligned notches extending along said side edges thereof, said base portion terminating in wing portions, said intermediary device consisting of a slider having in-turned ends mounted around said wing portions, a long narrow tongue connected to said slider, said tongue extending over said panel and being disposed in said notches, and said tongue being inserted between a slider and said mounting track of an adjacent panel.

8. The assembly of claim 6 wherein said notches in each of said mounting panels are aligned notches and an open space being created by said notches of adjacent panels, said mounting track having at least one hook disposed in each of said open space, and said intermediary device being mounted in said hooks in said open space.

9. The assembly of claim 6 wherein said intermediary device being a thin flat spring clip having two oppositely extending arms, said clip being mounted in said notch, one of said arms being on the outer surface of said panel, and the other of said arms being disposed at the inner surface of said panel with said track between said other arm and said inner surface of said panel.

10. The assembly of claim 1 wherein said framework includes a support deck completely covering the area to be covered by said panels, and said tracks being mounted to said support deck.

11. The assembly of claim 1 wherein each of said surface indentations is a recess.

12. The assembly of claim 1 wherein said panels are made of slate.

13. A mounting assembly for mounting panels to a structure for forming a roof or wall for the structure wherein the structure has framework, said framework including an underlying support surface spanning the roof or wall, said assembly being in combination with said structure and said panels, said assembly comprising a plurality of spaced parallel generally flat mounting tracks, each of said tracks having a base portion mounted against and to said support surface, each of said tracks having fastener accommodating structure, a plurality of rows of mounting panels, each of said rows of panels being associated with a respective one of said tracks, each of said panels having two spaced side edges, surface indentations in each of said panel side edges, a fastener in the form of an intermediary device engaged in each of said surface indentations, each of said fasteners being secured to its said track by being detachably hooked around said fastener accommodating structure, each of said panels being imperforate except for any perforations at said surface indentations, said rows of panels being mounted in an overlapping manner with respect to each other to cover and conceal said fasteners, each of said tracks having an offset portion extending away from said base portion and spaced from said support surface, said offset portion comprising said fastener accommodating structure, said mounting track being made of a one-piece member comprising said base portion having a bent transition portion which terminates in said offset portion, said base portion being generally parallel to said offset portion, and drain holes being in said transition portion.

14. The assembly of claim 13 wherein said intermediary devices include a loop connected to the rear side of each of said panels.

15. The assembly of claim 14 wherein each of said surface indentations is a notch cut into said side edges of said panel and form a pair of aligned notches, and said loop being a band secured around said panel and disposed in said aligned notches.

16. The assembly of claim 13 wherein said intermediary device consists of a receiving member and an insertion member, said receiving member having a head portion mounted in a crater in its mounting panel and terminating in a hollow tube at the underside of its mounting panel, said insertion member having a head portion mounted in a crater in its mounting panel and terminating in a rod which is inserted into said hollow tube to thereby form a shallow U having a long portion paralleling said panel, and said mounting track including fingerlike projections engaging said long portion.

17. The assembly of claim 13 wherein said intermediary devices consist of a band wrapped around each mounting panel, a plurality of holes through said band at the underside of said mounting panel, a fastening member threaded through said holes, said mounting track having a plurality of projections, and said fastening member being mounted over said projections.

18. The assembly of claim 13 wherein each of said surface indentations is a notch.

19. The assembly of claim 13 wherein each of said surface indentations is a recess.

20. The assembly of claim 13 wherein said panels are made of slate.

21. The assembly of claim 13 wherein said support surface is a solid deck.

22. A mounting clip for detachably mounting a panel to a track or deck, said clip being of generally T-shape and made of a one piece integral spring wire member, said T-shape having two aligned arms and a generally coplanar perpendicular leg located where said arms are juxtaposed each other, said wire member terminating in two free ends, each of said free ends having a first portion of said wire member integral with its said free end, said first portion being bent toward its said free end but spaced therefrom to form a U-shaped outwardly opening clamp arm which comprises a respective one of said aligned arms for being clamped around an edge of a panel to mount said clip to the panel whereby said clip may be simultaneously mounted to two side by side panels, each of said first portions having a second portion of said wire member integral with its said first portion, said second portion being bent back toward said first portion to form a double thickness at a part of said clamp arm opposite its said free end, each of said clamp arms thereby being of U shape with two spaced sides joined by a bight, said free end being on one of said sides of said U shape and both of said first portion and said second portion being on the other of said sides of said U shape to form a double thickness from said first portion and said second portion on said other side of said U-shape, and each of said second portions being bent perpendicularly away from each of said arms and said second portions being integral with each other to form a double thickness perpendicular extension which comprises said leg for engagement with a track to mount the side by side panels to the track.

23. A mounting assembly for mounting panels to a structure for forming a roof or wall for the structure wherein the structure has framework, said framework including an underlying support surface spanning the roof or wall, said assembly being in combination with said structure and said panels, said assembly comprising a plurality of spaced parallel generally flat mounting tracks, each of said tracks having a base portion mounted against and to said support surface, each of said tracks being made of a one piece member comprising a base portion having a bent transition portion which terminates in an offset portion spaced from said base portion, said base portion being generally parallel to said offset portion, said offset portion having an exposed edge spaced from said transition portion, a plurality of rows of mounting panels, each of said rows of mounting panels being associated with a respective one of said tracks, a fastener for each of said panels, each of said fasteners being a spring clip resiliently detachably hooked around said panel and said track, said spring clip being hooked to said track by extending around said exposed edge of said offset portion and extending toward said transition portion of said track, and said rows of panels being mounted in an overlapping manner with respect to each other to cover and conceal said fasteners.

24. The assembly of claim 23 wherein said panels are made of slate.

25. The assembly of claim 23 wherein said support surface is a solid deck.

* * * * *